US009759432B2

(12) United States Patent
Chung et al.

(10) Patent No.: US 9,759,432 B2
(45) Date of Patent: Sep. 12, 2017

(54) COOKING APPLIANCE AND METHOD FOR CONTROLLING THE SAME

(71) Applicant: LG ELECTRONICS INC., Seoul (KR)

(72) Inventors: Jaehun Chung, Seoul (KR); Songyi Han, Seoul (KR); Sooyeon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 434 days.

(21) Appl. No.: 14/474,541

(22) Filed: Sep. 2, 2014

(65) Prior Publication Data

US 2015/0060432 A1 Mar. 5, 2015

(30) Foreign Application Priority Data

Sep. 2, 2013 (KR) ..... 10-2013-0105131

(51) Int. Cl.

| | |
|---|---|
| ***A21B 1/00*** | (2006.01) |
| ***F24C 15/32*** | (2006.01) |
| ***F24C 15/16*** | (2006.01) |

(52) U.S. Cl.

CPC ..... *F24C 15/322* (2013.01); *F24C 15/16* (2013.01)

(58) Field of Classification Search

CPC ..... F24C 15/322; F24C 15/16; F24C 15/12; F24C 15/14; A23B 4/044; A23B 4/048; A23B 4/03; A23B 4/01; A23B 4/031; A23B 7/005; A23B 7/0053; A23B 7/01; A23B 7/02; A23B 7/0205

See application file for complete search history.

(56) References Cited

U.S. PATENT DOCUMENTS 3,955,488 A * 5/1976 Wheeler ..... A23L 3/00 99/467

* cited by examiner

*Primary Examiner* — Shawntina Fuqua
(74) *Attorney, Agent, or Firm* — Ked & Associates, LLP

(57) ABSTRACT

A cooking appliance and a method for controlling the same are provided. The cooking appliance may include a body having a cooking chamber, a frame, a pair of fixed guides mounted to inner side surfaces of an upper portion of the cooking chamber, respectively, the pair of fixed guides to slidably support the frame, and a tray to be supported by the frame, the tray to provide a food to be dried the tray is in the cooking chamber.

21 Claims, 9 Drawing Sheets

COOKING APPLIANCE AND METHOD FOR CONTROLLING THE SAME

CROSS-REFERENCE TO RELATED APPLICATION(S)

Pursuant to 35 U.S.C. §119(a), this application claims priority to Korean Patent Application No. 10-2013-0105131, filed in Korea on Sep. 2, 2013, which is hereby incorporated by reference as if fully set forth herein.

BACKGROUND

1. Field

A cooking appliance and a method for controlling the same are disclosed herein.

2. Background

Generally, cooling appliances are well known as an apparatus for cooking a food by heating the food. Such a cooking appliance includes a microwave oven, a gas range, an electric oven, a gas oven, an oven range, etc.

In particular, the oven range is an integrated kitchen appliance including a combination of an oven for heating an article to be cooked by dry heat in a sealed state and a range disposed over the oven, to cook an article to be cooked through direct heating under the condition that the article is laid on an upper surface of the range. Such an oven range is classified into a gas oven range and an electric oven range in accordance with the kind of a heat source thereof.

In accordance with an installation method thereof, the oven range is also classified into a built-in type oven range built into kitchen cabinetry or the like such that the oven range harmonizes with the kitchen cabinetry or a wall and a free standing type oven range independently installed at a position desired by the user.

The oven range generally has a hexahedral shape, and includes a cook top, on which a container containing a food to be cooked is placed, an oven for cooking a food in a state of receiving the food, and a back guard for outwardly exhausting fumes and gases generated in the oven.

The cook top directly heats a container containing a food under the condition that the container is laid on the cook top, to cook the food. The cook top has an upwardly-exposed upper surface. A plurality of burners is mounted on the cook top. As the burners, general exposure type burners may be used. The exposure type burners may be mounted to be exposed at the upper surface of the cook top. Sealed type burners encased in ceramic glass may also be used.

An oven may be disposed beneath the cook top, to cook a food in a state of receiving the food therein. An oven cavity is formed in the interior of the oven. The oven cavity occupies a large portion of the interior of the oven range.

The oven cavity forms a cooking chamber. At least one heater is installed in the cooking chamber. The heater may be installed in a state of being embedded in a wall of the cooking chamber or in a state of being exposed to the interior of the cooking chamber.

A rack, on which a cooking article to be cooked may be laid, may be installed in the cooking chamber, to uniformly transfer heat not only to upper and lower surfaces of the food, but also to a lower surface of the food.

The rack is fabricated by welding wires to form a wire net structure. The rack is mounted to support ribs formed at opposite inner side surfaces of the cooking chamber, to elongate in forward and rearward directions of the cooking chamber.

Plural support ribs may be provided and vertically spaced apart from one another, in order to enable adjustment of rack installation level.

The rack may be separably mounted to selected ones of the support ribs. The rack may be withdrawn by the user by a certain distance in a state of being supported by the selected support ribs.

Meanwhile, conventional ovens only have a function of cooking a food by heat, for example, heating or baking the food.

In recent years, however, there has been an increased tendency to eat foods such as fruit or vegetables, in addition to fish, after drying the foods. For drying, such foods should be dried in the sun for a prolonged period of time. Otherwise, it is necessary to use a dehydrator.

For drying, an oven may also be used because heat is utilized, even though the heating temperature of the oven may differ from that of the dehydrator.

However, the rack, which is generally fabricated in the form of a wire net, has a structure making it difficult to dry foods having a slice shape under the condition that the foods are laid on the rack.

Furthermore, the tray, which has a plate structure having a plurality of through holes, may have a problem in that the tray cannot be mounted to support ribs used to mount a rack in conventional ovens.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, the same reference numbers will be used throughout the drawings to refer to the same or like parts, and repetitive disclosure has been omitted.

Figure 1:
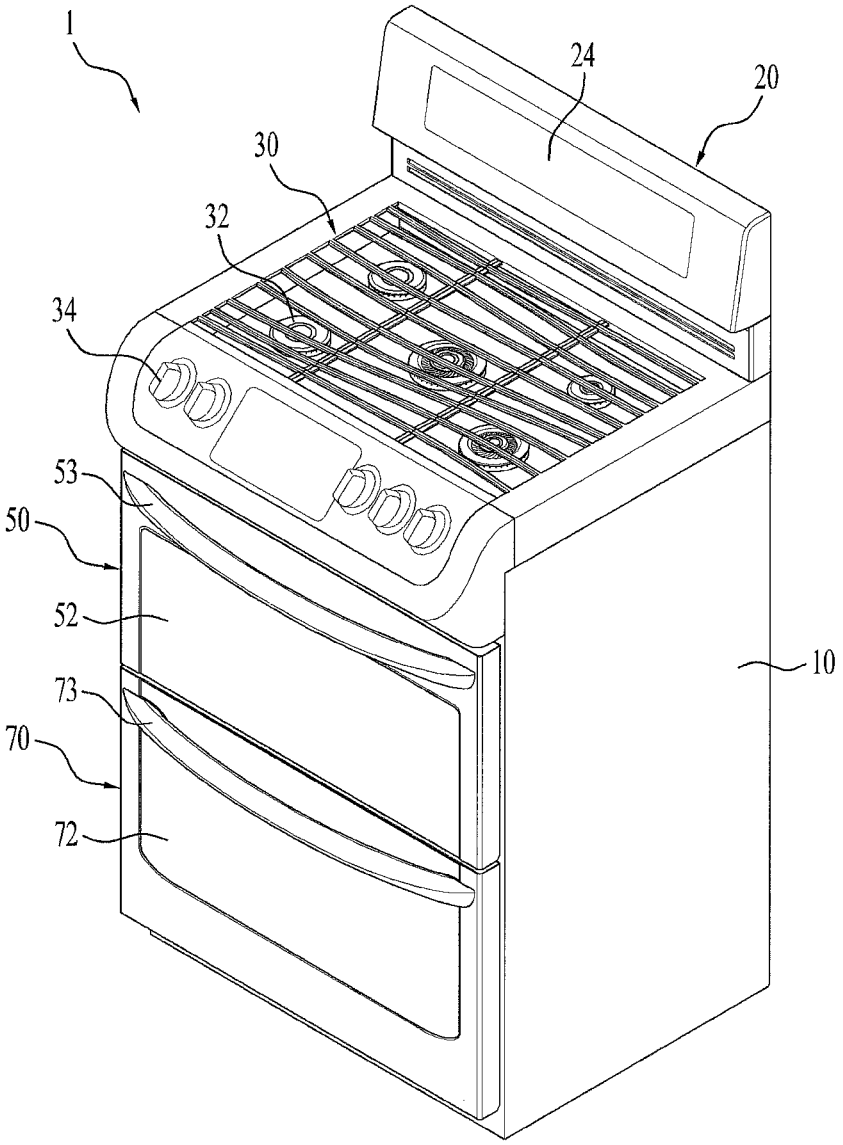
FIG. 1 is a perspective view illustrating a cooking appliance according to an embodiment of the present invention.
Figure 2:
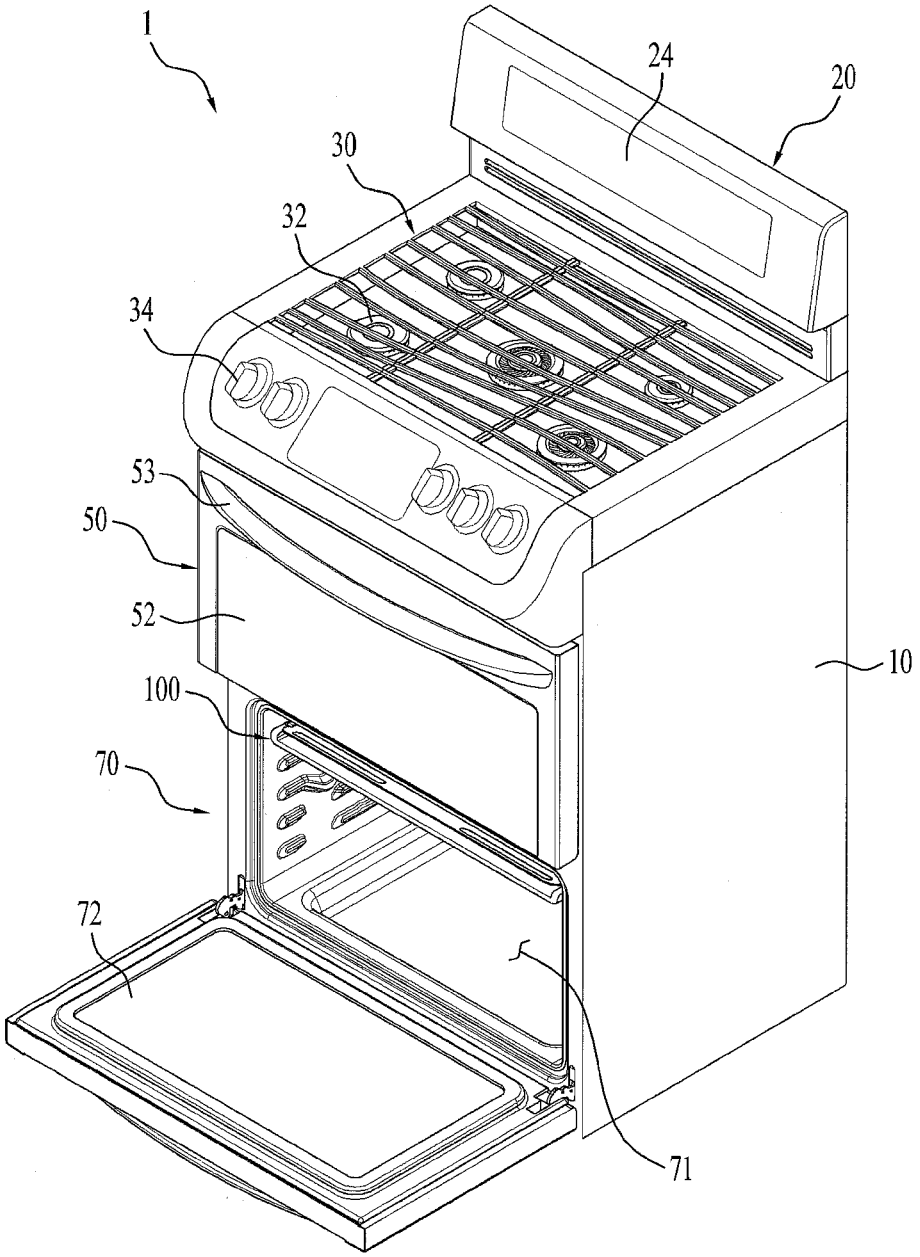
FIG. 2 is a perspective view illustrating an opened state of a lower oven door in the cooking appliance of FIG. 1.

FIG. 1 is a perspective view illustrating a cooking appliance according to an embodiment of the present invention. FIG. 2 is a perspective view illustrating an opened state of a lower oven door in the cooking appliance of FIG. 1.

The cooking appliance, which is designated by reference numeral "1" in FIG. 1, is an oven range using gas or electricity as a heat source. The cooking appliance 1 may include a body 10 generally having a hexahedral parallelepiped shape.

The cooking appliance of the present invention may be applied to a microwave oven, an electric oven, etc. without being limited to the illustrated oven range, so long as the appliance includes a door, a frame, and a drying tray.

The following description will be given in conjunction with an oven range.

The cooking appliance 1 may include one or more ovens 50 and 70 for cooking a food in a state of receiving the food therein, and a cook top 30 disposed over the body 10, to cook a food laid thereon.

The cook top 30 directly heats a container containing a food under the condition that the container is laid on the cook top 30, to cook the food. The cook top 30 has an upwardly-exposed upper surface. A plurality of heaters 32 is mounted on the cook top 30, to heat containers.

A cook top manipulator 34 may be provided at a front side of the cook top 30, to control the heaters 32 installed at the cook top 30. The cook top manipulator 34 may be disposed at an inclined surface of the front side of the cook top 30, to allow the user to easily access the cook top manipulator 34. Meanwhile, the cook top manipulator 34 may include a plurality of knobs corresponding to respective heaters 32 and, as such, it may be possible to individually operate the heaters 32.

As described above, one or more ovens 50 and 70 are disposed beneath the cook top 30, to cook foods in a state of receiving the foods therein. In the drawings, two ovens 50 and 70 are illustrated as being provided at the cooking appliance 1. However, the present invention may be applied to the case in which a single oven or three or more ovens are provided.

The ovens may include an upper oven 50 disposed beneath the cook top 30, and a lower oven 70 disposed beneath the upper oven 50.

A cooking chamber 71 may be formed in each of the ovens 50 and 70, to receive a food.

The ovens 50 and 70 are opened or closed by oven doors 52 and 72, respectively. Each of the oven doors 52 and 72 is pivotable about one side of the corresponding one of the ovens 50 and 70.

Handles 53 and 73 may be provided at respective oven doors 52 and 72, to enable the user to easily open or close the oven doors 52 and 72.

As illustrated in FIG. 2, each of the oven doors 52 and 72 may be mounted by a pair of door hinges 17 having a horizontally extending hinge shaft, to be vertically pivotable. In this case, the user may downwardly open the oven doors 52 and 72 while grasping the handles 53 and 73, respectively.

The cooking chamber 71 is a space in which an article to be cooked, namely, a food, is received and cooked. To this end, at least one heater is provided within the cooking chamber 71, to heat a food received in the cooking chamber 71.

The heater installed in the oven may include at least one of sheath heaters, charcoal heaters, halogen heaters, broil heaters, and bake heaters.

The kinds and numbers of such heaters may be varied in accordance with which one of gas and electricity is used as a heat source, the sizes and shapes of the cooking appliance and cooking chamber, heating temperature, and kinds of foods.

Meanwhile, as will be described later, a convection fan 79 (FIG. 3) may be provided within the cooking chamber 71, to force convection of air in the cooking chamber 71. In this case, hot air generated by the heater in the cooking chamber 71 may be uniformly supplied to a food in the cooking chamber 71.

In addition, the cooking appliance 1 may further include a back guard 20 disposed behind the cook top 30. The back guard 20 functions to outwardly exhaust fumes and gases generated when foods are cooked in the ovens 50 and 70. The back guard 20 is disposed at a higher level than the cook top 30.

The back guard 20 communicates with the cooking chambers 71 of the ovens 50 and 70. An outlet is formed at the back guard 20, to achieve smooth exhaust of fumes and gases generated in the cooking chambers 71.

The back guard 20 may be provided with a display 22 to display cooking states of the ovens 50 and 70. The display 22 may provide information as to cooking times, cooking temperatures, etc. of the ovens 50 and 70 to the user. Of course, it may be possible to manipulate the ovens 50 and 70 through the display 22.

Figure 3:
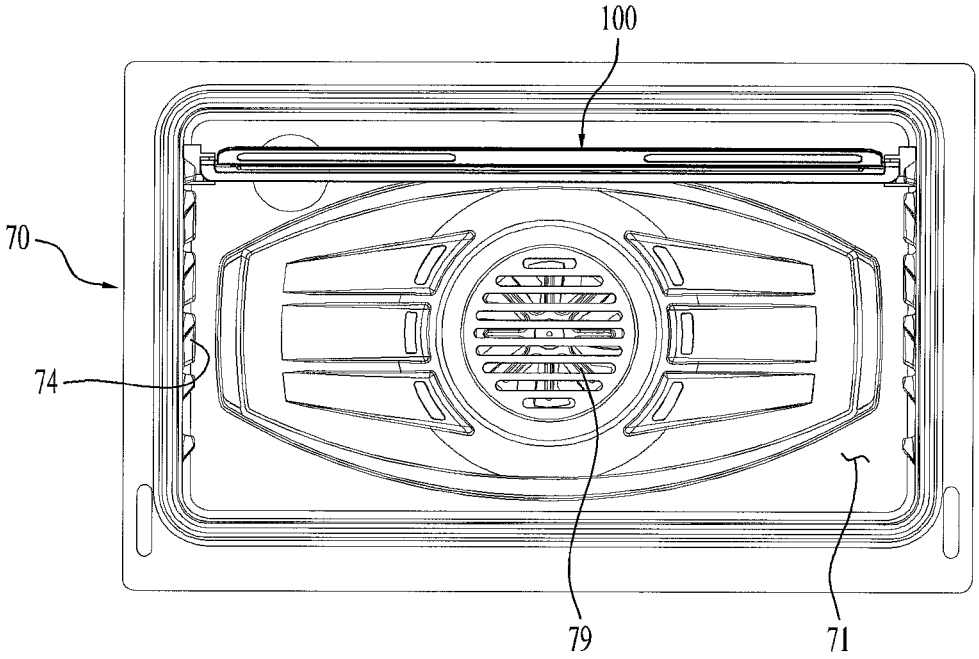
FIG. 3 is a front view illustrating an inner case forming a lower oven and an interior of the inner case.
Figure 4:
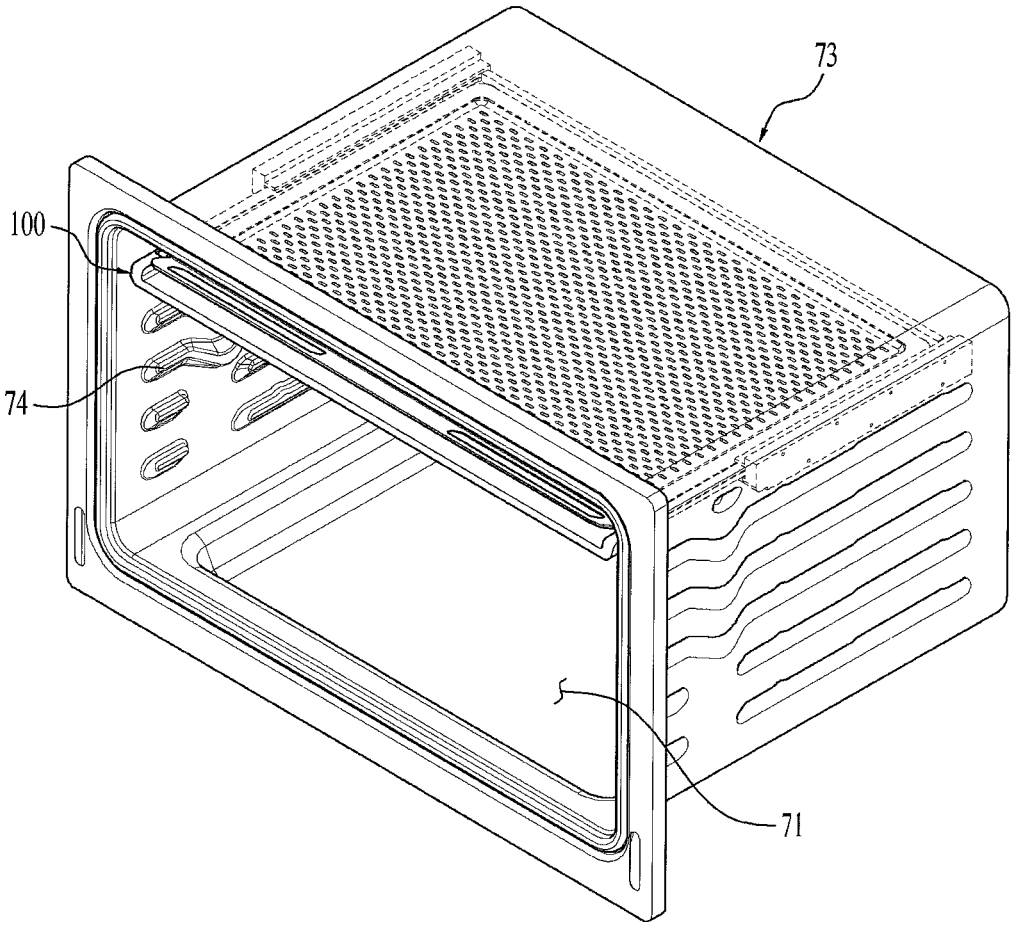
FIG. 4 is a perspective view illustrating the inner case and the interior thereof.

FIGS. 3 and 4 illustrate an inner case 73 forming the lower oven and a tray assembly 100 mounted in the inner case 73, through a front view and a perspective view.

The inner case 73 is mounted in an outer case forming the body 10, to form the lower oven 70.

A plurality of rack support ribs 74 spaced apart from one another by a predetermined distance may protrude from opposite inner side surfaces of the lower oven 70, to allow mounting of a rack (not shown), on which a food may be laid, to be cooked.

Generally, the rack has a wire net structure. The rack is slidably mounted on selected ones of the rack support ribs.

Accordingly, the rack positions a food at a desired level in an internal space of the cooking chamber 71 of the lower oven 70 and, as such, hot air generated by the heater may be uniformly transferred to the food.

One or more heaters (not shown) as described above may be installed in the cooking chamber 71, to supply heat. The heaters may be installed at least one of top, bottom, left, right and rear walls of the cooking chamber 71 in an embedded state or in a state of being exposed to the interior of the cooking chamber 71.

The convection fan 79 is installed at the rear wall of the cooking chamber 71, to force convection of air in the cooking chamber 71 in order to uniformly supply heat supplied from the heaters to the interior of the cooking chamber 71.

Alternatively, the convection fan 79 may be installed at the top wall of the cooking chamber 71. However, it may be preferable for the convection fan 79 to be installed at the rear wall of the cooking chamber 71 in order to achieve enhanced efficiency and to prevent the convection fan 79 from interfering with the heaters.

Generally, foods to be dried are disposed on a tray in a state of being cut into a thin slice shape, for promotion of drying. In the present invention, it may be preferable that the tray assembly 100 for mounting of the tray be disposed just beneath a top surface of the cooking chamber 71.

Accordingly, when foods are disposed in the cooking chamber 71, to be subjected to general cooking in the cooking chamber 71, or foods are cooked under the condition that the foods are disposed on a rack, and the rack is then mounted to the rack support ribs 74, it may be possible to prevent the foods or rack from interfering with the tray assembly 100.

Figure 5:
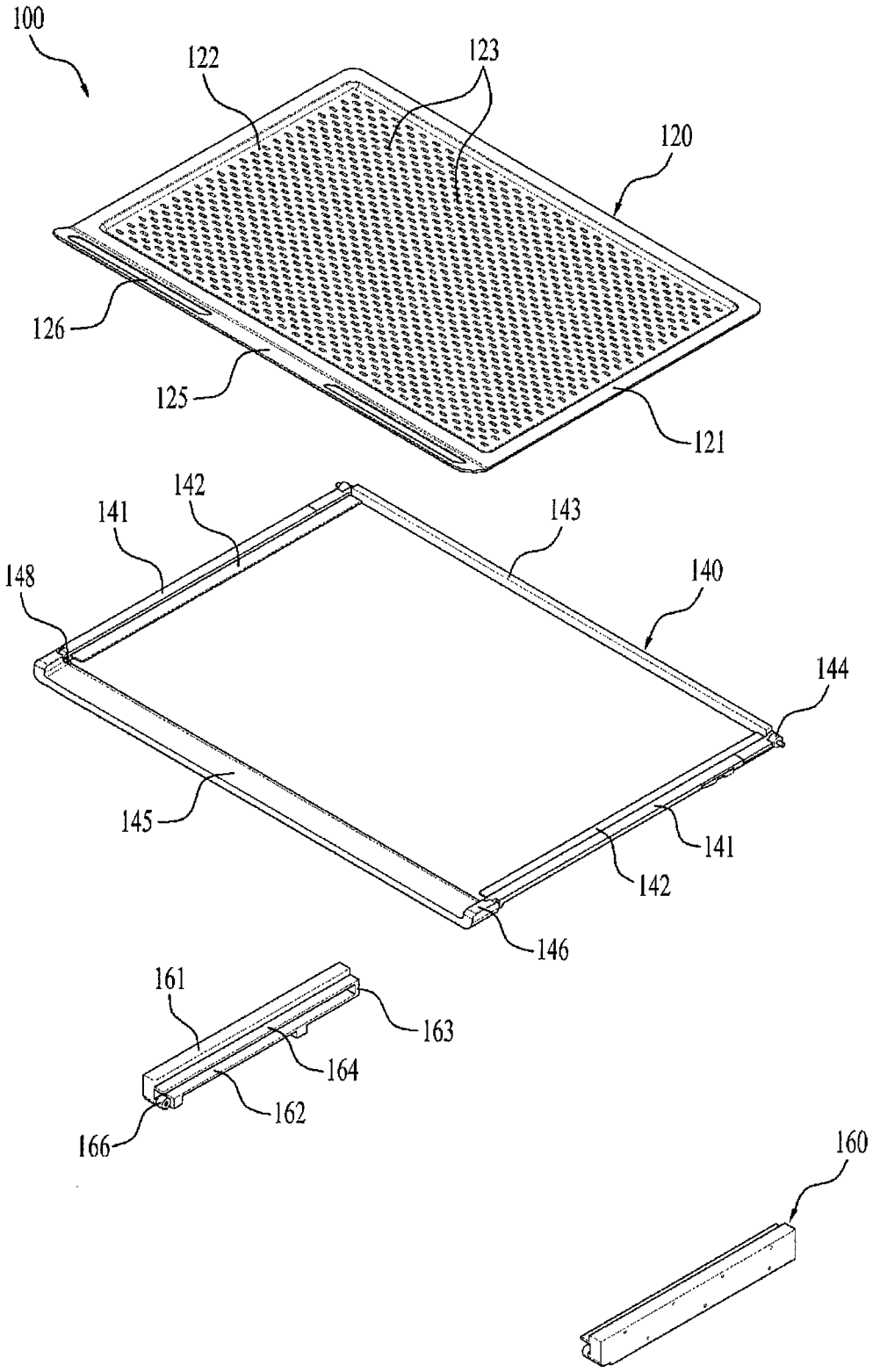
FIG. 5 is an exploded perspective view of a structure of the tray assembly according to a preferred embodiment of the present invention.

FIG. 5 is an exploded perspective view of a structure of the tray assembly 100 according to a preferred embodiment of the present invention. Hereinafter, the structure of the tray assembly 100 will be described with reference to FIG. 5.

The tray assembly 100 includes a pair of fixed guides 160 mounted to an inner surface of the upper wall of the cooking chamber 71, a frame 140 slidably supported by the fixed guides 160, and a tray 120 seated on the frame 140 in a supported state.

The fixed guides 160 may be mounted to opposite inner side surfaces of an upper portion of the cooking chamber 71, respectively, by a plurality of screws. To this end, each fixed guide 160 may be formed with a plurality of screw holes.

The fixed guides 160 receive opposite side portions of the frame 140, to slidably support the frame 140.

The frame 140 may generally have a structure formed by frames connected to one another while forming four sides of a rectangular shape.

That is, the frame 140 may include a pair of side frames 141 slidably supported by respective fixed guides 160, a rear frame 143 to connect rear ends of the side frames 141, and a front frame 145 to connect front ends of the side frames 141.

The tray 120 may be slidably supported by the side frames 141 of the frame 140.

The tray 120 may have a metal plate structure having a peripheral edge portion 121, an inner drying portion 122 recessed as compared to the peripheral edge portion 121, to have a concave shape, and a plurality of through holes 123 formed at the inner drying portion 122.

The peripheral edge portion 121 forms four sides of the rectangular plate structure. The drying portion 122 is surrounded by the peripheral edge portion 121, and is an area on which foods to be dried will be laid. The drying portion 122 preferably has an upper surface that is slightly lower than an upper surface of the peripheral edge portion 121.

Since the drying portion 122 has a concave shape, it may be possible to reduce a phenomenon in which foods to be dried fall from the tray 120 during movement of the tray 120 under the condition that the foods are laid on the tray 120.

Since the through holes 123 are formed at the tray 120, hot air may be easily uniformly transferred to the foods not only at the upper side of the tray 120, but also at the lower side of the tray 120.

The tray 120 may further include an inclined portion 125 upwardly inclined from a front end of the tray 120.

The inclined portion 125 may have an inclination of 10 to 40° from a front end of the peripheral edge portion 121.

The inclined portion 125 also functions as a handle to allow the user to conveniently draw or push the tray 120 mounted in the cooking chamber 71.

The tray 120 is mounted at the upper portion of the cooking chamber 71 near the top wall of the cooking chamber 71. For this reason, if the inclination of the inclined portion 125 is excessively great, it may be difficult for the user to put the fingers into a gap between the top wall and the inclined portion 125. Accordingly, it is preferable that the inclination of the inclined portion 125 be 10 to 40°.

The tray 120 may be made of a metal material. In this case, the edge portion 121, drying portion 122, and inclined portion 125 of the tray 120 may be integrated.

Although drying temperature is lower than heating temperature for general cooking, it is preferable for the tray 120 to be made of a metal material exhibiting high resistance to heat and superior strength because the tray 120 may be heated to high temperature by the heaters.

In particular, the tray 120 is preferably made of an aluminum material exhibiting excellent heat resistance, superior strength, high thermal conductivity, and lightness.

Since the tray 120 is moved by the user in a grasped state, it may be better for the tray 120 to be lighter.

A grasping portion 126 made of a rubber material or a heat-resistant plastic may be attached to an upper surface of the inclined portion 125.

The tray 120 made of metal may be too hot to allow the user to draw the tray 120 while grasping the tray 120, and may be slippery. In this regard, it may be possible to more conveniently use the tray 120 by attaching the grasping portion 126 made of a material exhibiting excellent friction and low thermal conductivity.

Meanwhile, the fixed guides 160 may have a "U"-shaped cross-section in order to enclose corresponding portions of outer side, upper and lower surfaces of the side frames 141.

Each fixed guide 160 preferably has a shape capable of supporting the corresponding side frame 141 not only at the lower side thereof, but also at the upper side thereof, because the fixed guide 160 should support the frame 140 while preventing the frame 140 from being forwardly downwardly inclined when the user draws the frame 140.

In detail, each fixed guide 160 may include a side wall 161 mounted to the corresponding inner side surface of the cooking chamber 71, a lower rib 162 horizontally extending from an inner surface of the side wall 161, an upper rib 164 horizontally extending from the inner surface of the side wall 161 while being spaced apart from the lower rib 162 by a predetermined distance, and a vertical rib 163 vertically connected between rear ends of the lower and upper ribs 162 and 164.

The side wall 161 is mounted to the inner surface of the corresponding inner wall of the cooking chamber 71 by a plurality of screws. To this end, the side wall 161 may have a plurality of screw holes.

The lower rib 162 supports a lower surface of the corresponding side frame 141. On the other hand, the upper rib 164 supports an upper surface of the corresponding side frame 141.

When the user pushes the frame 140 into the cooking chamber 71, the rear end of the side frame 141 corresponding to the fixed guide 160 contacts the vertical rib 163 of the fixed guide 160 and, as such, the vertical rib 163 functions as a stopper to limit a maximum insertion position of the tray 120.

Each fixed guide 160 may also include a roller 166 mounted to a front end of the fixed guide 160, to support the lower surface of the corresponding side frame 141. Each side frame 141 may include a roller 144 mounted to the side surface of the rear end of the side frame 141 and supported by the corresponding fixed guide 160 while rolling along the corresponding fixed guide 160.

Accordingly, the side frame 141 does not directly contact the lower rib 162 or upper rib 164 and, as such, it may be possible to reduce friction in accordance with rolling of the rollers 166 and 144. Thus, the frame 140 may smoothly slide along the fixed guides 160.

The roller 144 provided at the rear end of each side frame 141 is supported by the corresponding lower rib 162 at an early stage when the frame 140 is withdrawn. After the frame 140 is withdrawn by a predetermined distance, the roller 144 is supported by the corresponding upper rib 164 because the center of weight of the frame 140 is shifted ahead of the roller 166 provided at the front end of the fixed guide 160.

Meanwhile, the side frames 141 may include support ribs 142 formed at respective inner surfaces of the side frames 141, to support opposite sides of the tray 120, respectively.

Each support rib 142 extends horizontally from the inner surface of the corresponding side frame 141. In this case, it is preferable that the support rib 142 be integrally connected to the rear frame 143, to be more firmly supported.

The support rib 142 may be formed to have a smaller thickness than the side frame 141 and, as such, may have a lower upper surface than an upper surface of the side frame 141.

When the tray 120 is pushed into the cooking chamber 71 along the frame 140, to be seated on the support ribs 142, portions of the inner surfaces of the side frames 141 disposed at a level slightly higher than the support ribs 142 may guide opposite side ends of the tray 120, to seat the opposite side ends of the tray 120 at desired positions.

The rear frame 143 may have a higher upper surface than the upper surfaces of the side frames 141.

Since the side frames 141 are formed to be higher than the support ribs 142, and the rear frame 143 is formed to be higher than the side frames 141, the height difference between the upper surface of each support rib 142 and the upper surface of the rear frame 143 may be greater than the thickness of the tray 120.

Accordingly, when the tray 120 is pushed into the cooking chamber 71 in a state of being seated on the frame 140, the rear end of the tray 120 can be inserted into the cooking chamber 71 while pushing the rear frame 143 of the frame 140.

Meanwhile, the front frame 145 may be pivotably coupled to the side frames 141.

In this case, the front frame 145 is pivotably coupled to the side frames 141 by pivot pins 148 provided at respective front ends of the side frames 141.

The pivot pins 148 may limit pivotal movement of the front frame 145 within an angle of 90° such that the front frame 145 extends horizontally or vertically to be flush with or perpendicular to the side frames 141.

Accordingly, when the user upwardly pivots the front frame 145 to extend vertically after pushing the frame 140 into the cooking chamber 71 along the fixed guides 160, the front frame 145 does not forwardly protrude and, as such, may not defile the appearance of the cooking appliance.

The front frame 145 may have an upper surface flush with the upper surfaces of the support ribs 142. The front frame 145 may also have opposite side portions 146 each protruding upwardly to have an upper surface flush with the upper surface of the corresponding side frame 141.

In this case, accordingly, the front frame 145 may guide the tray 120 to be easily inserted into the cooking chamber 71 when pivoted to extend horizontally. In this state, the protruded inner surfaces of the opposite side portions 146 may guide opposite sides of the tray 120, together with the inner surfaces of the side frames 141, to allow the tray 120 to be easily inserted.

Similarly to the tray 120, the frame 140 may be made of a metal material. Preferably, the frame 140 is made an aluminum material, which is light.

The fixed guides 160 may be made of a heat-resistant plastic, similarly to the inner case 73 forming an inner surface of the cooking chamber 71.

Hereinafter, operation of the tray assembly of the cooking appliance will be described with reference to FIGS. 6 to 10. The following description will be given in conjunction with configurations provided at one side of the cooking appliance, for convenience of description, because the configurations at both sides of the cooking appliance are identical.

Figure 6:
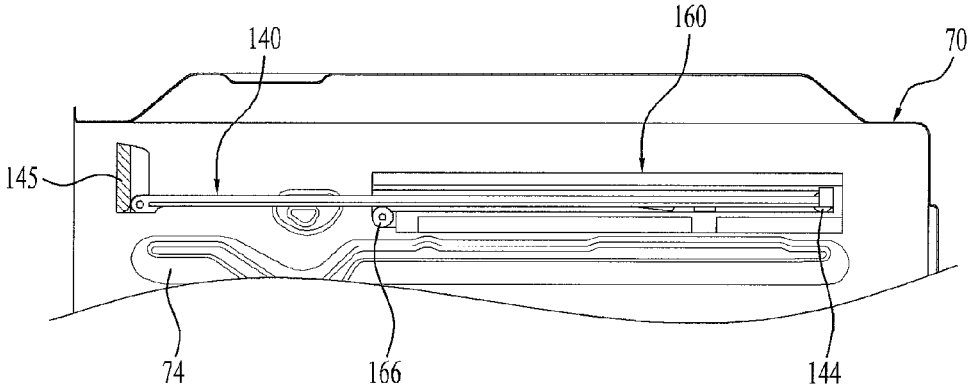
FIGS. 6 to 10 are side views illustrating operation states when the tray assembly is used in the oven.

FIG. 6 illustrates a state in which the frame 140 is supported by the fixed guide 160 mounted to the inner side surface of the upper portion of the cooking chamber 71.

The front frame 145 is in a state of being pivoted to extend vertically and, as such, only the front surface of the front frame 145 is seen in front of the cooking chamber 71.

Figure 7:
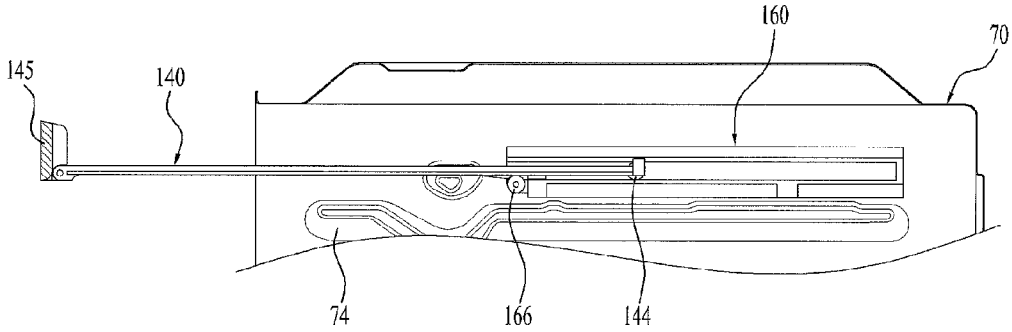

When the user draws a lower portion of the front frame 145 after opening the oven door 72, the frame 140 may be withdrawn by a predetermined distance, as illustrated in FIG. 7.

When the frame 140 is completely withdrawn, the roller 144 disposed at the rear end of the frame 140 comes into contact with the roller 16 disposed at the front end of the fixed guide 160. When the frame 140 is further withdrawn in this state, the frame 140 may be completely separated from the fixed guide 160.

In practice, however, it is desirable for the frame 140 to be withdrawn by the predetermined distance because it may be difficult for the frame 140 to bear turning moment due to the weight thereof when the frame 140 is completely withdrawn to bring the rollers 144 and 166 into contact with each other.

Figure 8:
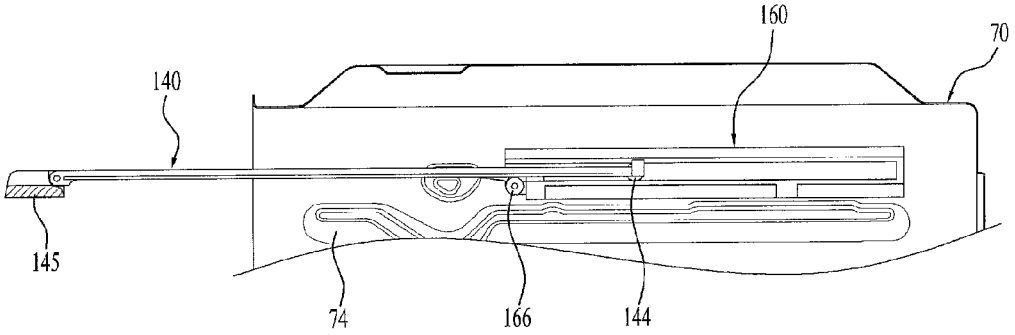

Thereafter, the user downwardly pivots the front frame 145 of the frame 140, to cause the front frame 145 to extend horizontally, as illustrated in FIG. 8.

Figure 9:
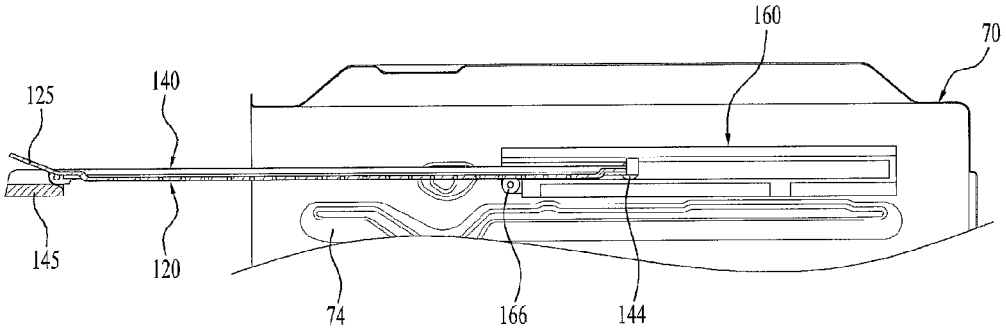

In this state, the tray 120, on which foods to be dried are laid, is seated on the frame 140, as illustrated in FIG. 9.

The frame 140 and tray 120 are subsequently inserted into the cooking chamber 71. The insertion of the frame 140 and tray 120 is carried out until the roller 144 of the frame 140 comes into contact with the vertical rib 163 of the fixed guide 160, as illustrated in FIG. 10.

Figure 10:
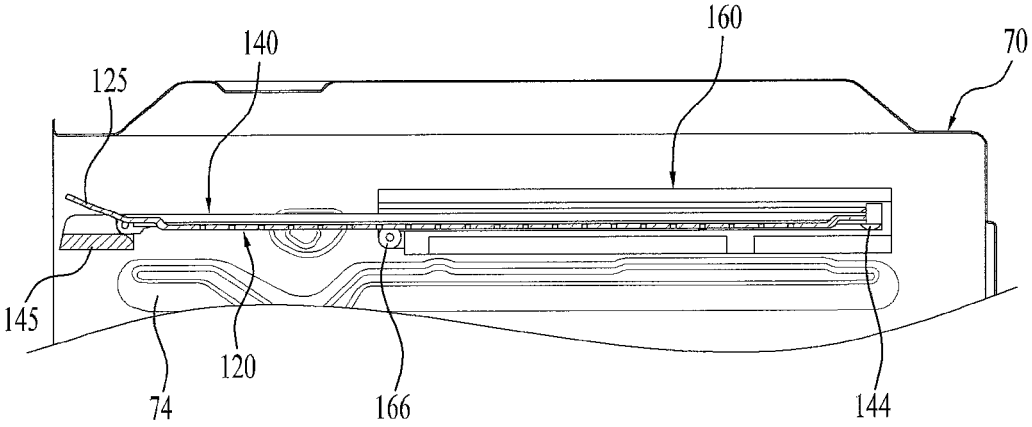

Although the procedures of FIGS. 9 and 10 have been separately described, the state of FIG. 10 may be achieved by slidably pushing the tray 120 in a state of being laid on the frame 140 such that the frame 140 is first inserted into the cooking chamber 71, and the tray 120 is then inserted into the cooking chamber 71 while sliding along the frame 140.

Meanwhile, in the case in which both the upper oven 50 and the lower oven 70 are installed at the cooking appliance, the upper oven 50 is generally more frequently used than the lower oven 70.

Even in the lower oven 70, which is used at relatively low frequency, a plurality of rack support ribs 74 may be provided, to selectively adjust the level of the rack. Even in this case, however, the upper portion of the lower oven 70 is used at the lowest frequency.

Therefore, in a cooking appliance provided with a plurality of ovens, it is preferable for the tray assembly of the present invention to be installed at the upper portion of the lower oven.

Figure 11:
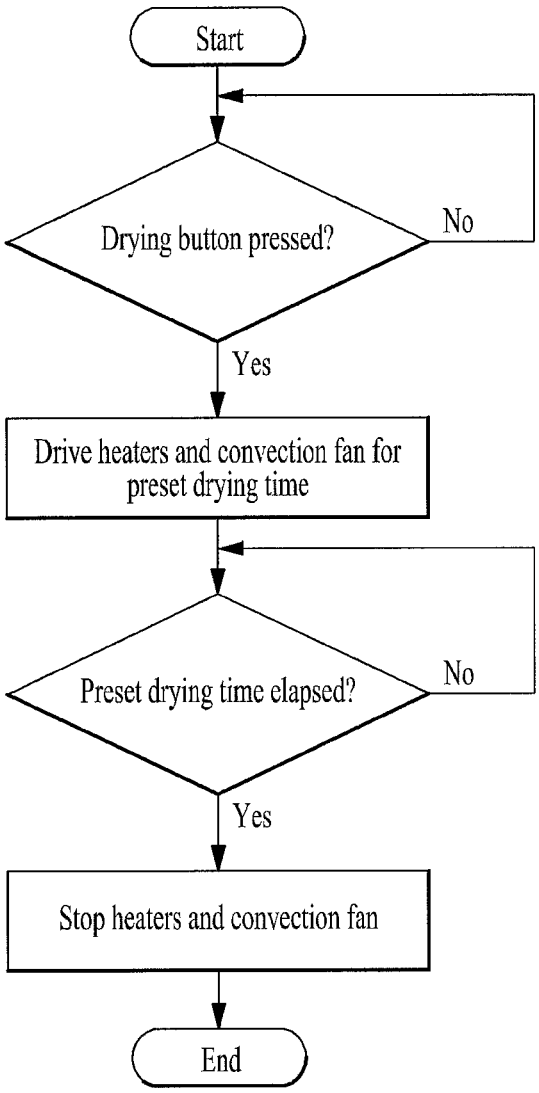
FIG. 11 is a flowchart illustrating a method for controlling the cooking appliance of the present invention.

FIG. 11 is a flowchart illustrating a method for controlling the cooking appliance according to the present invention. Hereinafter, the control method of the cooking appliance will be described with reference to FIG. 11 and the drawings preceding FIG. 11.

As illustrated in FIGS. 1 and 2, it may be possible to control the oven, using the display 22 provided at the back guard 20. Of course, the oven may be controlled by a controller provided separately from the display 22.

The controller may be provided with an input unit for inputting cooking time and heating temperature of the oven, operation or non-operation of the convection fan, and operation time of the convection fan.

In the cooking appliance of the present invention, the input unit includes a drying button.

The drying button or input unit may be configured to set a drying time and a heating time in a drying mode.

Of course, if there is no setting of time and temperature within a preset time after pressing of the drying button, the cooking appliance may operate in accordance with previously set conditions.

When the user presses the drying button after laying foods on the tray 120, the controller drives the heaters and convection fan for a preset time, to heat the cooking chamber 71 to a predetermined heating temperature.

Since drying of foods is achieved in accordance with evaporation of moisture from the foods, drying of foods may be rapidly achieved when convection is effectively carried out, in addition to heating.

The controller determines whether a preset drying time has elapsed, and stops the heaters and convection fan when the preset drying time has elapsed.

As apparent from the above description, embodiments disclosed herein provide at least the following advantages.

According to embodiments, the tray is withdrawably mounted in the cooking chamber of the cooking appliance, to enable the cooking appliance to be used as a dehydrator. In addition, the drying button is provided at the controller, and drying conditions may be set by the controller and, as such, it may be possible to conveniently dry foods, using the cooking appliance.

As apparent from the above description, according to embodiments, it may be possible to easily mount the tray in the oven and, as such, a drying function may be carried out even in the oven.

Since the tray may be slidably seated on the slidably withdrawable frame, it may be possible to conveniently use the tray.

When the drying tray is not used, the upper space of the frame is hidden by pivoting the front frame to extend vertically after separating the tray and, as such, the appearance of the cooking appliance may not be defiled.

In addition, the tray may be mounted at an upper portion of the lower oven exhibiting lowest frequency of use, and may be separable from the frame. Accordingly, the tray does not obstruct use of the oven under normal conditions.

Embodiments disclosed herein provide a cooking appliance that may include a body having a cooking chamber, a frame, a pair of fixed guides mounted to inner side surfaces of an upper portion of the cooking chamber, respectively, the pair of fixed guides to slidably support the frame, and a tray to be supported by the frame, the tray to provide a food to be dried the tray is in the cooking chamber.

The frame may include a pair of side frames to be slidably supported by the pair of fixed guides, respectively, a rear frame to couple to rear ends of the side frames, and a front frame to couple to front ends of the side frames.

The fixed guides may have a U-shaped cross-section to enclose corresponding portions of an outer side surface, an upper surface and a lower surface of the side frames.

Each of the fixed guides separately may include a side wall to couple to the corresponding inner side surface of the cooking chamber, a lower rib to horizontally extend from an inner surface of the side wall, an upper rib to horizontally extend from the inner surface of the side wall, and the upper rib is spaced from the lower rib by a predetermined distance, and a vertical rib to vertically couple to a rear end of the lower rib and to a rear end of the upper rib.

Each of the fixed guides may include a roller at a front end of the fixed guide, the roller to support a lower surface of the corresponding side frame, and each of the side frames includes a roller at a side surface of the rear end of the side frame, and the roller of the side frame is supported by the corresponding fixed guide while rolling along the corresponding fixed guide.

Support ribs may be at respective inner surfaces of the side frames, the support ribs to support opposite sides of the tray, respectively.

The support ribs may have upper surfaces that are lower than upper surfaces of the side frames, respectively, and the rear frame has an upper surface that is higher than the upper surfaces of the side frames.

The front frame may be pivotably coupled to the side frames.

The front frame may be pivotably coupled to the side frames by pivot pins provided at respective front ends of the side frames, and the pivot pins to limit pivotal movement of the front frame within an angle of 90° such that the front frame extends horizontally or vertically to be flush with the side frames or to be perpendicular to the side frames.

The tray may have a metal plate structure and a plurality of through holes, the metal plate structure including a peripheral edge portion and an inner drying portion, the inner drying portion being recessed as compared to the peripheral edge portion, the metal plate structure to have a concave shape, and the plurality of through holes provided at the inner drying portion.

The tray may include an inclined portion that is inclined upwardly at a front end of the tray.

The frame may be made of aluminum.

The fixed guides may be made of a heat-resistant plastic.

The cooking appliance may further include a convection fan and at least one heater provided within the cooking chamber. When the food to be dried is on the tray, the heater and the convection fan may operate to dry the food.

The cooking appliance may further include a cook top at an upper surface of the body, an upper oven disposed under the cook top, and the upper oven to include a cooking chamber and a heater therein, and a lower oven disposed under the upper oven, and the lower oven to include a cooking chamber and a heater therein. The fixed guides may be at opposite inner side surfaces of an upper portion of the cooking chamber in the lower oven, respectively.

Embodiments disclosed herein further provide a cooking appliance that may include a body having a cooking chamber, a frame, a tray, a first fixed guide at a first inner side surface of a first portion of the cooking chamber, and a second fixed guide at a second inner side surface of the first portion of the cooking chamber, the first fixed guide and the second fixed guide to support the frame, and the frame to support the tray.

The cooking appliance may be configured to dry a food on the tray when the tray is in the cooking chamber and the food is on the tray.

The frame may include a first side frame to be slidably supported by the first fixed guide, a second side frame to be slidably supported by the second fixed guide, a rear frame to couple to a rear end of the first side frame and to a rear end of the second side frame, and a front frame to couple to a front end of the first side frame and to a front end of the second side frame.

The first fixed guide may have a U-shaped cross-section to enclose portions of an outer side surface, an upper surface and a lower surface of the first side frame.

The first fixed guide may include a side wall to couple to the first inner side surface of the cooking chamber, a first rib to extend from an inner surface of the side wall;

a second rib to extend from the inner surface of the side wall, and the second rib spaced from the first rib by a predetermined distance, and a third rib to couple to a rear end of the first rib and to a rear end of the second rib.

The first side frame includes a support rib to support the tray.

The support rib may have an upper surface that is lower than an upper surface of the first side frame, and the rear frame has an upper surface that is higher than the upper surface of the first side frame.

The tray may have a metal plate structure and a plurality of through holes. The metal plate structure may include a peripheral edge portion and an inner drying portion. The inner drying portion may be recessed as compared to the peripheral edge portion. The metal plate structure may have a concave shape, and the plurality of through holes may be provided at the inner drying portion.

Embodiments disclosed herein further provide a method for controlling a cooking appliance that may include determining whether a drying button has been selected when a tray is provided at a cooking chamber of the cooking appliance, driving, when the drying button has been selected, a heater and a convection fan to dry food on the tray, the heater and the convection fan provided in the cooking chamber, and stopping the heater and the convection fan after a preset drying time elapses.

The drying button may be at a backguard controller provided at the cooking appliance, and the preset drying time is set by a user.

It will be apparent to those skilled in the art that various modifications and variations can be made in the present invention without departing from the spirit or scope of the inventions. Thus, it is intended that embodiments covers modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a body having a cooking chamber;

a frame;

a pair of fixed guides mounted to inner side surfaces of an upper portion of the cooking chamber, respectively, the pair of fixed guides to slidably support the frame; and a tray to be supported by the frame, the tray to provide a food to be dried the tray is in the cooking chamber, wherein the frame comprises:

a pair of side frames to be slidably supported by the pair of fixed guides, respectively;

a rear frame to couple to rear ends of the side frames; and a front frame pivotably coupled to front ends of the side frames.

2. The cooking appliance according to claim 1, wherein the fixed guides have a U-shaped cross-section to enclose corresponding portions of an outer side surface, an upper surface and a lower surface of the side frames.

3. The cooking appliance according to claim 2, wherein each of the fixed guides separately comprises:

a side wall to couple to the corresponding inner side surface of the cooking chamber;

a lower rib to horizontally extend from an inner surface of the side wall;

an upper rib to horizontally extend from the inner surface of the side wall, and the upper rib is spaced from the lower rib by a predetermined distance; and a vertical rib to vertically couple to a rear end of the lower rib and to a rear end of the upper rib.

4. The cooking appliance according to claim 3, wherein:

each of the fixed guides includes a roller at a front end of the fixed guide, the roller to support a lower surface of the corresponding side frame; and each of the side frames includes a roller at a side surface of the rear end of the side frame, and the roller of the side frame is supported by the corresponding fixed guide while rolling along the corresponding fixed guide.

5. The cooking appliance according to claim 1, wherein support ribs are at respective inner surfaces of the side frames, the support ribs to support opposite sides of the tray, respectively.

6. The cooking appliance according to claim 5, wherein:

the support ribs have upper surfaces that are lower than upper surfaces of the side frames, respectively; and the rear frame has an upper surface that is higher than the upper surfaces of the side frames.

7. The cooking appliance according to claim 1, wherein:

the front frame is pivotably coupled to the side frames by pivot pins provided at respective front ends of the side frames; and the pivot pins to limit pivotal movement of the front frame within an angle of 90° such that the front frame extends horizontally or vertically to be flush with the side frames or to be perpendicular to the side frames.

8. The cooking appliance according to claim 1, wherein the tray has a metal plate structure and a plurality of through holes, the metal plate structure including a peripheral edge portion and an inner drying portion, the inner drying portion being recessed as compared to the peripheral edge portion, the metal plate structure to have a concave shape, and the plurality of through holes provided at the inner drying portion.

9. The cooking appliance according to claim 1, wherein the tray includes an inclined portion that is inclined upwardly at a front end of the tray.

10. The cooking appliance according to claim 1, wherein the frame is made of aluminum.

11. The cooking appliance according to claim 1, wherein the fixed guides are made of a heat-resistant plastic.

12. The cooking appliance according to claim 1, further comprising:

a convection fan and at least one heater provided within the cooking chamber, wherein, when the food to be dried is on the tray, the heater and the convection fan operate to dry the food.

13. The cooking appliance according to claim 1, further comprising:

a cook top at an upper surface of the body;

an upper oven disposed under the cook top, and the upper oven to include a cooking chamber and a heater therein; and a lower oven disposed under the upper oven, and the lower oven to include a cooking chamber and a heater therein, wherein the fixed guides are at opposite inner side surfaces of an upper portion of the cooking chamber in the lower oven, respectively.

14. A cooking appliance comprising:

a body having a cooking chamber;

a frame;

a tray;

a first fixed guide at a first inner side surface of a first portion of the cooking chamber; and a second fixed guide at a second inner side surface of the first portion of the cooking chamber, the first fixed guide and the second fixed guide to support the frame, and the frame to support the tray, wherein the frame comprises:

a first side frame to be slidably supported by the first fixed guide;

a second side frame to be slidably supported by the second fixed guide;

a rear frame to couple to a rear end of the first side frame and to a rear end of the second side frame; and a front frame to couple to a front end of the first side frame and to a front end of the second side frame, wherein the first fixed guide comprises:

a side wall to couple to the first inner side surface of the cooking chamber;

a first rib to extend from an inner surface of the side wall;

a second rib to extend from the inner surface of the side wall, and the second rib spaced from the first rib by a predetermined distance; and a third rib to couple to a rear end of the first rib and to a rear end of the second rib.

15. The cooking appliance according to claim 14, wherein the cooking appliance is configured to dry a food on the tray when the tray is in the cooking chamber and the food is on the tray.

16. The cooking appliance according to claim 14, wherein the first fixed guide has a U-shaped cross-section to enclose portions of an outer side surface, an upper surface and a lower surface of the first side frame.

17. The cooking appliance according to claim 14, wherein the first side frame includes a support rib to support the tray.

18. The cooking appliance according to claim 17, wherein:

the support rib has an upper surface that is lower than an upper surface of the first side frame; and the rear frame has an upper surface that is higher than the upper surface of the first side frame.

19. The cooking appliance according to claim 14, wherein the tray has a metal plate structure and a plurality of through holes, the metal plate structure including a peripheral edge portion and an inner drying portion, the inner drying portion being recessed as compared to the peripheral edge portion, the metal plate structure to have a concave shape, and the plurality of through holes provided at the inner drying portion.

20. A method for controlling a cooking appliance according to claim 1, comprising:

determining whether a drying button has been selected when a tray is provided at a cooking chamber of the cooking appliance;

driving, when the drying button has been selected, a heater and a convection fan to dry food on the tray, the heater and the convection fan provided in the cooking chamber; and stopping the heater and the convection fan after a preset drying time elapses.

21. The method according to claim 20, wherein:

the drying button is at a backguard controller provided at the cooking appliance; and the preset drying time is set by a user.

* * * * *